US012637743B2

(12) United States Patent
Liu et al.

(10) Patent No.: US 12,637,743 B2
(45) Date of Patent: May 26, 2026

(54) LOW-ALLOYED MAGNESIUM ALLOY WITH HIGH DUCTILITY AND HIGH DAMPING CAPACITIES AT ROOM TEMPERATURE AND PREPARATION METHOD THEREOF

(71) Applicant: Central South University, Changsha (CN)

(72) Inventors: Chuming Liu, Changsha (CN); Shunong Jiang, Changsha (CN); Yajie Ma, Changsha (CN); Yonghao Gao, Changsha (CN); Yingchun Wan, Changsha (CN)

(73) Assignee: Central South University, Changsha (CN)

( * ) Notice: Subject to any disclaimer, the term of this patent is extended or adjusted under 35 U.S.C. 154(b) by 0 days.

(21) Appl. No.: 18/740,588

(22) Filed: Jun. 12, 2024

(65) Prior Publication Data

US 2025/0034681 A1 Jan. 30, 2025

(30) Foreign Application Priority Data

Jul. 24, 2023 (CN) ..... 202310911580.9

(51) Int. Cl.

| | |
|---|---|
| ***C22C 23/06*** | (2006.01) |
| ***C21D 8/021*** | (2026.01) |
| ***C21D 8/0247*** | (2026.01) |

(52) U.S. Cl.

CPC ..... *C22C 23/06* (2013.01); *C21D 8/021* (2013.01); *C21D 8/0273* (2013.01)

(58) Field of Classification Search

None

See application file for complete search history.

(56) References Cited

FOREIGN PATENT DOCUMENTS

| | | | |
|---|---|---|---|
| CN | 1851020 | A | 10/2006 |
| CN | 101798651 | A | 8/2010 |

(Continued)

OTHER PUBLICATIONS

English language machine translation of CN-113444944-A. Generated Oct. 3, 2025. (Year: 2025).*

(Continued)

*Primary Examiner* — Brian D Walck

(74) *Attorney, Agent, or Firm* — Bayramoglu Law Offices LLC

(57) ABSTRACT

A low-alloyed magnesium (Mg) alloy with high ductility and high damping capacities at room temperature and a preparation method thereof are provided. The low-alloyed Mg alloy with high ductility and high damping capacities includes the following elements in percentage by mass: 0.5-1.5% of Gadolinium (Gd), 0.5-0.9% of Zinc (Zn), 0.3-0.6% of Zirconium (Zr), and the balance of Mg (Mg). By adding low-content Gd, Zn and Zr elements to a Mg matrix, the low-alloyed Mg alloy not only has effects of solid solution strengthening, precipitation strengthening and fine-grain strengthening, but also, under the interaction effect of a plurality of elements, promotes the non-basal dislocation (Continued)

slipping of Mg alloy, and stimulates the dislocation damping mechanism, thereby effectively improving the plasticity and damping properties of Mg alloy. The low-alloyed Mg alloy with high ductility and high damping capacities at room temperature has excellent plasticity and damping properties at room temperature.

7 Claims, 1 Drawing Sheet

(56) References Cited

FOREIGN PATENT DOCUMENTS

| | | | | | |
|---|---|---|---|---|---|
| CN | 103421999 | A | * | 12/2013 | |
| CN | 105483485 | A | | 4/2016 | |
| CN | 110863130 | A | * | 3/2020 | ..... C21D 9/70 |
| CN | 111235450 | A | * | 6/2020 | ..... C22C 23/06 |
| CN | 113444944 | A | * | 9/2021 | ..... C22C 1/03 |
| CN | 115305396 | A | | 11/2022 | |
| JP | 2012219325 | A | * | 11/2012 | |
| WO | 2012003522 | A2 | | 1/2012 | |

OTHER PUBLICATIONS

English language machine translation of CN-111235450-A. Generated Oct. 3, 2025. (Year: 2025).*
English language machine translation of CN-110863130-A. Generated Oct. 3, 2025. (Year: 2025).*
English language machine translation of JP-2012219325-A. Generated Oct. 3, 2025. (Year: 2025).*
English language machine translation of CN-103421999-A. Generated Oct. 3, 2025. (Year: 2025).*
GB/T 13665-2007, Test method for damping capacity of metallic damping materials-Torsion pendulum method and bending vibration method, China National Standarts, 2007, pp. 1-8, General Administration of Quality Supervision, Inspection and Quaratine of the People's Republic of China.
GB/T228.1-2010, Metallic materials-Tensile testing-Part 1: Method of test at room temperature, China National Standarts, 2010, pp. 1-61, General Administration of Quality Supervision, Inspection and Quaratine of the People's Republic of China.
Shan Yu-Lang, et al., Effects of Gd content on properties of Mg-0.5Zn-0.4Zr-x Gd biodegradable magnesium alloys, Transactions of Materials and Heat Treatment, 2016, pp. 21-26, vol. 37, No. 6.

* cited by examiner

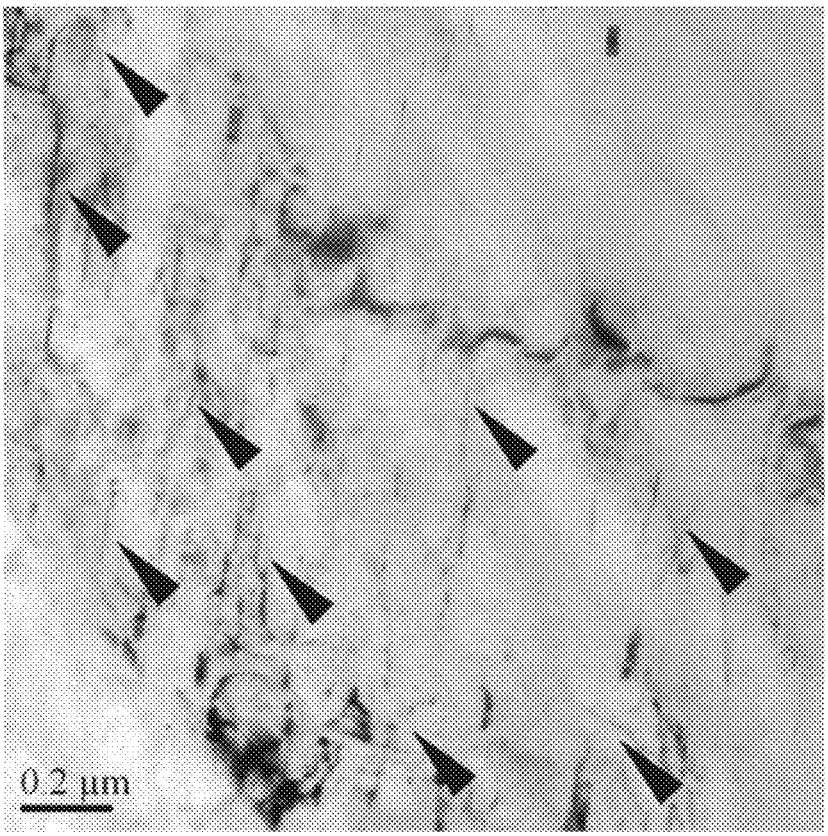
0.2 μm

LOW-ALLOYED MAGNESIUM ALLOY WITH HIGH DUCTILITY AND HIGH DAMPING CAPACITIES AT ROOM TEMPERATURE AND PREPARATION METHOD THEREOF

CROSS REFERENCE TO THE RELATED APPLICATIONS

This application is based upon and claims priority to Chinese Patent Application No. 202310911580.9, filed on Jul. 24, 2023, the entire contents of which are incorporated herein by reference.

TECHNICAL FIELD

The present disclosure relates to the technical field of Magnesium (Mg) alloy materials, and particularly relates to a low-alloyed Mg alloy with high ductility and high damping capacities at room temperature and a preparation method thereof.

BACKGROUND

Magnesium (Mg) alloys are currently the lightest metal structural materials in engineering applications, having significant advantages in lightweight reduction, vibration and noise reduction, energy consumption reduction, etc. Mg alloys have potential application value and broad application prospects in high-speed trains, rail transit, automobile industry, and other fields. Furthermore, Mg alloys are easy to recycle and are environmentally friendly and green engineering materials. However, metallic Mg has a hexagonal close-packed crystal structure with limited independent slip systems, so it is difficult to initiate slip at room temperature, thereby resulting in poor plasticity and severely restricting its application and development.

Studies have shown that adding various alloying elements to Mg alloys simultaneously for multi-element alloying can effectively improve the strength, plasticity and comprehensive properties of Mg alloys. However, the adding of various alloying elements simultaneously easily and significantly affects the subsequent formation of Mg alloys. This is because Mg alloys are prone to production of strong basal texture during deformation processing, which is not conducive to improving ductility and damping capacities of Mg alloys, while wrought Mg alloys usually have superior mechanical properties than cast Mg alloys. This requires that the alloying elements added to wrought Mg alloys are capable of weakening the basal texture or forming non-basal texture, which is conducive to dynamic recrystallization of Mg alloy. The dynamic precipitated phases generated during the deformation process are capable of inhibiting the growth of recrystallized grains. These alloying elements mainly include rare earth (RE) and calcium (Ca), and each of the elements is capable of weakening the basal texture or forming a new texture different from the basal texture, which is due to the segregation effect of the element at the grain boundary. However, the cost of RE is high, the maximum solid solubility of Ca in Mg is only 1.34 wt. %, and both RE and Ca have higher chemical activity than Mg, so that they are prone to oxidation and burning during smelting, and it is difficult to accurately control the composition of the designed alloy, which is not conducive to obtaining Mg alloys that meet the performance requirements.

Therefore, those skilled in the art are in an urgent need to provide a low-alloyed Mg alloy with high ductility and high damping capacities at room temperature.

SUMMARY

The objective of the present disclosure is to provide a low-alloyed magnesium (Mg) alloy with high ductility and high damping capacities at room temperature and a preparation method thereof. The low-alloyed Mg alloy with high ductility and high damping capacities at room temperature provided in the present disclosure has a low degree of alloying, and also high ductility and high damping capacities at room temperature.

In order to achieve the objective described above, the present disclosure provides the following technical solution:

The present disclosure provides a low-alloyed Mg alloy with high ductility and high damping capacities at room temperature, and the Mg alloy includes the following elements in percentage by weight: 0.5-1.5% of Gadolinium (Gd), 0.5-0.9% of Zinc (Zn), 0.3-0.6% of Zirconium (Zr), and the balance of Mg.

Preferably, the low-alloyed Mg alloy with high ductility and high damping capacities at room temperature includes the following elements in percentage by mass: 0.6-1.4% of Gd, 0.6-0.8% of Zn, 0.35-0.55% of Zr, and the balance of Mg.

Preferably, a mass ratio of Gd to Zn in the low-alloyed Mg alloy with high ductility and high damping capacities at room temperature is $1.0 \leq Gd/Zn \leq 3.0$.

Preferably, a mass percentage of impurity elements in the low-alloyed Mg alloy with high ductility and high damping capacities at room temperature is no more than 0.1%.

Preferably, the impurity elements include Ferrum (Fe), Silicon (Si), Cuprum (Cu) and Nickel (Ni), where the mass percentage of Fe is no more than 0.03%, the mass percentage of Si is no more than 0.03%, the mass percentage of Cu is no more than 0.01%, and the mass percentage of Ni is no more than 0.01%.

The present disclosure further provides a method for preparing the low-alloyed Mg alloy with high ductility and high damping capacities at room temperature described in the above technical solution, and the method includes the following steps:

(1) sequentially melting, refining, keeping static and semi-continuous casting alloy raw materials to obtain a Mg alloy ingot; and (2) sequentially performing homogenization annealing and extrusion of the Mg alloy ingot obtained in the step (1) to obtain the low-alloyed Mg alloy with high ductility and high damping capacities at room temperature.

Preferably, the temperature of the refining in the step (1) is 720-730° C., and the duration of the refining is 5-15 min.

Preferably, the temperature of the semi-continuous casting in the step (1) is 705-715° C., the speed of the semi-continuous casting is 100-300 mm/min, and the circulating water flow rate of the semi-continuous casting is 5-25 $m^3/h$.

Preferably, the holding temperature of the homogenization annealing in the step (2) is 480-530° C., and the holding time of the homogenization annealing is 20-30 h.

Preferably, the temperature of the extrusion in the step (2) is 350-450° C., the ratio of the extrusion is >20, and the speed of the extrusion is 0.2-10 m/min.

The present disclosure provides a low-alloyed Mg alloy with high ductility and high damping capacities at room temperature, and the Mg alloy includes the following elements in percentage by mass: 0.5-1.5% of Gadolinium (Gd), 0.5-0.9% of Zinc (Zn), 0.3-0.6% of Zirconium (Zr), and the balance of Mg (Mg). In the present disclosure, a low concentration of rare earth element Gd is added to the Mg matrix. The Gd can be dissolved into the Mg matrix while refining the grains, which has the dual effects of solid solution strengthening and fine-grain strengthening, is capable of effectively reducing the c/a value of the Mg alloy and controlling the stacking fault energy, and is conducive to the activation of non-basal slip, thereby improving the plasticity of the Mg alloy. In yet another aspect, the addition of the Gd weakens the basal texture generated after deformation of the Mg alloy or changes the type of texture, which is conducive to the initiation of basal slipping and tension twinning during room temperature deformation, thereby improving the plasticity of the Mg alloy. In the present disclosure, Zn and Zr elements are added to the Mg matrix. The Zn and Zr elements not only improve the activation energy of non-basal slip but also form precipitated phases that are dispersed in the Mg matrix, thus achieving the dual effects of precipitation strengthening and fine-grain strengthening. The above effects jointly promote the non-basal dislocation slip of the Mg alloy and stimulate the dislocation damping mechanism, so that the dislocations are less likely to entangle and accumulate during the deformation process, thereby effectively improving the ductility and damping capacities of the Mg alloy.

The results of the examples show that the low-alloyed Mg alloy with high ductility and high damping capacities at room temperature provided by the present disclosure has the ultimate tensile strength of 215-256 MPa, the tensile yield strength of 128-211 MPa, the elongation of 31.7-39.3%, and the room-temperature damping capacity (expressed by the reciprocal $Q^{-1}$ of the quality factor at a strain of $10^{-3}$) of 0.02-0.035. It can be seen that low alloying of Mg with Gd, Zn and Zr elements in the present disclosure is capable of making the Mg alloys have excellent ductility and damping capacities, and higher strength, particularly higher tensile yield strength, so that the application prospects of Mg alloys are broader.

BRIEF DESCRIPTION OF THE DRAWINGS

FIGURE is a transmission electron microscopy (TEM) image of a sample in Example 2 of the present disclosure.

DETAILED DESCRIPTION OF THE EMBODIMENTS

The present disclosure provides a low-alloyed magnesium (Mg) alloy with high ductility and high damping properties at room temperature, and the Mg alloy includes the following elements in percentage by mass: 0.5-1.5% of Gadolinium (Gd), 0.5-0.9% of Zinc (Zn), 0.3-0.6% of Zirconium (Zr), and the balance of Mg (Mg).

In percentage by mass, the low-alloyed Mg alloy with high ductility and high damping capacities at room temperature includes 0.5-1.5% of Gd, preferably 0.6-1.4% of Gd, more preferably 0.7-1.3% of Gd. By adding Gd element and controlling its content within the above range, the present disclosure has the dual effects of solid solution strengthening and fine-grain strengthening, is capable of effectively reducing the c/a value of Mg alloy and controlling the stacking fault energy, and is conducive to the activation of non-basal slip, thereby improving the plasticity of the Mg alloy. Further, the addition of the Gd element is capable of weakening the basal texture generated after deformation of the Mg alloy or changing the type of texture, which is conducive to the initiation of basal slip and tension twinning during room temperature deformation, thereby improving the plasticity of the Mg alloy.

In percentage by mass, the low-alloyed Mg alloy with high ductility and high damping properties at room temperature includes 0.5-0.9% of Zn, preferably 0.6-0.8% of Zn, more preferably 0.65-0.75% of Zn. By adding Zn to the Mg matrix and controlling its content within the above range, the present disclosure not only improves the activation energy of non-basal slip, but also forms precipitated phases that are dispersed in the Mg matrix, thus achieving the dual effects of precipitation strengthening and fine-grain strengthening. The above effects jointly promote the non-basal dislocation slip of the Mg alloy and stimulate the dislocation damping mechanism, so that the dislocations are less likely to entangle and accumulate during the deformation process, thereby effectively improving the ductility and damping capacities of the Mg alloy.

In the present disclosure, a mass ratio of Gd to Zn in the low-alloyed Mg alloy with high ductility and high damping properties at room temperature is preferably $1.0 \leq Gd/Zn \leq 3.0$, more preferably $1.5 \leq Gd/Zn \leq 2.5$. By controlling the mass ratio of Gd to Zn within the above range, the present disclosure is capable of utilizing the interaction between Gd and Zn and simultaneously improving ductility and damping capacities of the Mg alloy. In the present disclosure, when the mass ratio of Gd to Zn is less than 1, both the ductility and damping capacities of the Mg alloy degrade, mainly because the Zn element improves the activation energy of non-basal slip, and due to the influence of element interactions, the ability of Gd to reduce the activation energy of non-basal slip is weakened. Additionally, because the Zn occupies some of the positions where Gd segregates at grain boundaries, the effect of Gd on the formation of non-basal texture by segregation is weakened, thereby increasing the intensity of basal texture. Therefore, the strength of the Mg alloy increases, while the damping capacities and ductility degrade significantly. When the mass ratio of Gd to Zn is higher than 3, the number of dynamically precipitated W phases ($Mg_3Gd_2Zn_3$) in which Gd and Zn are incoherent with the Mg matrix decreases, while the proportion of I phases ($Mg_3Zn_6Gd$) and $MgZn_2$ phases that are semi-coherent or coherent with the Mg matrix increases significantly. The increase of dynamically precipitated phases leads to the improvement of the strength of the Mg alloy, while the damping capacities degrade significantly, so it is impossible to simultaneously improve the ductility and damping capacities of the Mg alloy.

In percentage by mass, the low-alloyed Mg alloy with high ductility and high damping capacities at room temperature includes 0.3-0.6% of Zr, preferably 0.35-0.55% of Zr, more preferably 0.4-0.5% of Zr. By adding Zr to the Mg matrix and controlling its content within the above range, the present disclosure not only improves the activation energy of non-basal slip, but also forms precipitated phases that are dispersed in the Mg matrix, thus achieving the dual effects of precipitation strengthening and fine-grain strengthening.

The above effects jointly promote the non-basal dislocation slip of the Mg alloy and stimulate the dislocation damping mechanism, so that the dislocations are less likely to entangle and accumulate during the deformation process, thereby effectively improving the ductility and damping capacities of the Mg alloy.

In percentage by mass, the low-alloyed Mg alloy with high ductility and high damping capacities at room temperature includes the balance of Mg, except for the above elements.

In the present disclosure, a mass percentage of impurity elements in the low-alloyed Mg alloy with high ductility and high damping capacities at room temperature is preferably no more than 0.1%, more preferably no more than 0.06%. By controlling the content of inevitable impurities in the Mg alloy within the above range, the present disclosure is capable of reducing adverse effects of impurities on the Mg alloy, and ensuring the structural uniformity of the Mg alloy, which is more conducive to improving the ductility and damping capacities of the Mg alloy.

In the present disclosure, the impurity elements preferably include Ferrum (Fe), Silicon (Si), Cuprum (Cu) and Nickel (Ni), where the mass percentage of Fe is preferably no more than 0.03%, the mass percentage of Si is preferably no more than 0.03%, the mass percentage of Cu is preferably no more than 0.01%, and the mass percentage of Ni is preferably no more than 0.01%. The present disclosure is capable of further reducing the adverse effects of impurity elements on the Mg alloy by limiting inevitable impurity elements and the upper limit of the content of each impurity element.

The low-alloyed Mg alloy with high ductility and high damping capacities at room temperature provided in the present disclosure has a low degree of alloying, and also high ductility and high damping capacities at room temperature, which is capable of making the Mg alloy have higher strength, particularly higher tensile yield strength, so that the application prospects of Mg alloys are broader.

The present disclosure further provides a method for preparing the low-alloyed Mg alloy with high ductility and high damping capacities at room temperature described in the above technical solution, and the method includes the following steps:

(1) sequentially melting, refining, keeping static and semi-continuous casting alloy raw materials to obtain a Mg alloy ingot; and (2) sequentially performing homogenization annealing and extrusion of the Mg alloy ingot obtained in the step (1) to obtain the low-alloyed Mg alloy with high ductility and high damping capacities at room temperature.

In the present disclosure, the alloy raw materials are sequentially melted, refined, kept static and semi-continuously cast to obtain a Mg alloy ingot.

In the present disclosure, the alloy raw materials include a Mg ingot, a zinc ingot, an Mg-30% Gd master alloy, and an Mg-30% Zr master alloy.

In the present disclosure, the zinc ingot, the Mg-30% Gd master alloy and the Mg-30% Zr master alloy are preferably preheated before melting; and the preheating temperature is preferably 120-200° C. independently, and the preheating time is preferably 1-2 h independently. By preheating the above raw materials before use and controlling preheating parameters within the above range, the present disclosure is capable of ensuring that the moisture of the above raw materials is dried and the materials can be quickly melted when heated while oxidation and burning loss are reduced.

In the present disclosure, the burning loss rates of the Mg ingot and the zinc ingot as raw materials are preferably ignored, the burning loss rate of the Mg-30% Gd intermediate alloy is preferably calculated as 10-20%, and the burning loss rate of the Mg-30% Zr intermediate alloy is preferably calculated as 50-200%. By controlling the burning loss rate of each alloy raw material for batching, the present disclosure is more conducive to obtaining a Mg alloy with a target composition, thereby obtaining a Mg alloy that meets the performance requirements.

In the present disclosure, a melting process preferably includes the following steps: adding the Mg ingot and heating to 600-630° C. for melting, then heating to 780-810° C. after fully melting, then adding the Mg-30% Gd master alloy for melting, and then cooling to 755-765° C. after fully melting while simultaneously adding the zinc ingot and the Mg-30% Zr master alloy for melting. By controlling the above melting process, the present disclosure is capable of ensuring rapid melting of each alloy raw material and reducing the oxidation and burning loss of the alloy raw materials.

In the present disclosure, an atmosphere of the melting is preferably a mixed gas atmosphere of carbon dioxide ($CO_2$) and sulfur hexafluoride ($SF_6$). In the present disclosure, a 5 #covering agent is preferably added simultaneously when adding the Mg ingot. The present disclosure has no special requirements for the quality of the added 5 #covering agent, but it should be ensured that the final melt formed is fully covered by the 5 #covering agent. By controlling the melting atmosphere and adding the 5 #covering agent, the present disclosure is capable of effectively isolating the air, reducing the oxidation of the raw materials, and ensuring the cleanness of the melt, which is more conducive to obtaining a Mg alloy with the target composition.

In the present disclosure, the preferred refining temperature is preferably 720-730° C., and the preferred refining time is preferably 5-15 min. By controlling the refining temperature within the above range, the present disclosure is capable of ensuring the effective removal of impurities and gases in the refining process and ensuring the uniformity and density of the Mg alloy structure.

In the present disclosure, the refining is performed preferably by inflating with argon gas. The present disclosure has no special requirements for the specific operation steps of refining by means of inflating with argon gas, and conventional operation steps of refining by means of inflating with argon gas can be employed. Through refining by inflating with argon gas, the present disclosure is capable of making impurities in the melt float to the surface of the melt, which is more conducive to removing impurities.

In the present disclosure, the temperature of the keeping static is preferably 720-730° C., and time of the keeping static is preferably 30-90 min. By controlling the temperature and time of keeping static within the above ranges, the present disclosure is capable of further ensuring that impurities and gases in the melt are fully removed and ensuring that the Mg alloy has a uniform and dense structure.

In the present disclosure, the atmosphere of the keeping static is preferably a mixed gas atmosphere of $CO_2$ and $SF_6$. By controlling the atmosphere of keeping static, the present disclosure is capable of effectively isolating the air, reducing the oxidation of the raw materials, and ensuring the cleanness of the melt, which is more conducive to obtaining a Mg alloy with the target composition.

In the present disclosure, the temperature of the semi-continuous casting is preferably 705-715° C., the speed of the semi-continuous casting is preferably 100-300 mm/min, and the circulating water flow rate of the semi-continuous casting is 5-25 $m^3$/h. By controlling the values of parameters of the semi-continuous casting within the above ranges, the present disclosure is more conducive to obtaining a Mg alloy with fewer casting defects and a uniform structure.

After obtaining a Mg alloy ingot, the present disclosure sequentially performs homogenization annealing and extrusion of the Mg alloy ingot to obtain the low-alloyed Mg alloy with high ductility and high damping capacities at room temperature.

In the present disclosure, the preferred holding temperature for homogenization annealing is 480-530° C., and the preferred holding time for homogenization annealing is 20-30 h. By controlling the holding temperature and holding time for homogenization annealing within the above ranges, the present disclosure is more conducive to improving the structural uniformity of the Mg alloy ingots, eliminating casting stress, and achieving subsequent deformation processing.

In the present disclosure, the preferred cooling method for homogenization annealing is air cooling to room temperature.

In the present disclosure, the Mg alloy ingot obtained after homogenization annealing is preferably cut and machined by turning sequentially. By means of cutting and machining by turning, the present disclosure is capable of making the Mg alloy shaped appropriately and removing its surface oxidation layer before extrusion, which is more conducive to obtaining a Mg alloy with excellent properties by extrusion.

In the present disclosure, the preferred extrusion temperature is 350-450° C., the ratio of the extrusion is preferably >20; and the speed of the extrusion is preferably 0.2-10 m/min. By controlling the values of the extrusion parameters within the above ranges, the present disclosure is capable of reducing the deformation resistance during extrusion, achieving orderly fragmentation of coarse grains for grain refinement, and obtaining a structure with movable dislocations, thereby improving the plasticity and damping properties of the Mg alloy.

In the present disclosure, the preferred cooling method after extrusion is air cooling to room temperature.

The preparation method provided by the present disclosure is more conducive to improving the room-temperature plasticity and high damping properties of the Mg alloy, while making the Mg alloy have higher strength; and the preparation method is simple, has easily controllable parameters and the low cost, and is easy to realize industrial production.

The technical solution in present disclosure will be clearly and completely described below with reference to the examples in the present invention. Apparently, the examples described are merely some examples rather than all examples of the present invention. All other embodiments acquired by those of ordinarily skilled in the art without making creative efforts based on the embodiments of the present disclosure fall within the scope of protection of the present disclosure.

Example 1

A low-alloyed magnesium (Mg) alloy with high ductility and high damping capacities at room temperature is composed of the following elements in percentage by mass: 1.49% of Gadolinium (Gd), 0.89% of Zinc (Zn), 0.31% of Zirconium (Zr), 0.017% of impurities, and the balance of Mg (Mg), where the impurity elements include 0.005% of Ferrum (Fe), 0.01% of Silicon (Si), 0.001% of Cuprum (Cu), and 0.001% of Nickel (Ni).

A method for preparing the low-alloyed Mg alloy with high ductility and high damping properties at room temperature includes the following steps:

(1) Alloy raw materials were sequentially melted, refined, kept static and semi-continuously cast to obtain a Mg alloy ingot, specifically including: a mixed gas of carbon dioxide ($CO_2$) and sulfur hexafluoride ($SF_6$) was inflated into a resistance furnace, a Mg ingot (a burning loss rate was ignored) and a 5 #covering agent were added, heating to 600° C. was performed for melting, heating to 780° C. was performed after full melting, a Mg-30% Gd master alloy was added for melting (the burning loss rate was calculated as 100% for batching), and cooling to 760° C. was performed after full melting while adding a zinc ingot (the burning loss rate was ignored) and a Mg-30% Zr master alloy (the burning loss rate was calculated as 100% for batching) simultaneously for melting to obtain a melt; then the temperature of the melt was controlled at 730° C., argon (Ar) gas was inflated for refining for 10 min, then the melt was kept static in the mixed gas atmosphere of $CO_2$ and $SF_6$ for 60 min, and finally, when the temperature of the melt reached 710° C., the melt was transferred to a semi-continuous casting mold through a flow guide groove for semi-continuous casting at a casting speed of 200 mm/min and a circulating water flow rate of 10 $m^3$/h to obtain a Mg alloy ingot, where the zinc ingot, the Mg-30% Gd master alloy and the Mg-30% Zr master alloy were preheated at 150° C. for 1 h before melting.

(2) Homogenization annealing and extrusion of the Mg alloy ingot obtained in the step (1) were performed sequentially to obtain the low-alloyed Mg alloy with high ductility and high damping properties at room temperature. Specifically, homogenization annealing of the Mg alloy ingot was performed at 510° C. for 20 h, air cooling to room temperature was performed, then an ingot required for extrusion was formed by means of cutting and machining by turning sequentially. Extrusion was performed at 390° C. with an extrusion ratio of 25 and an extrusion speed of 0.75 m/min. Finally, air cooling to room temperature was performed to obtain a low-alloyed Mg alloy with high ductility and high damping capacities at room temperature.

Example 2

A low-alloyed magnesium (Mg) alloy with high ductility and high damping capacities at room temperature is composed of the following elements in percentage by mass: 1.35% of Gadolinium (Gd), 0.53% of Zinc (Zn), 0.53% of Zirconium (Zr), 0.011% of impurity elements, and the balance of Mg, where the impurity elements include 0.002% of Ferrum (Fe), 0.004% of Silicon (Si), 0.003% of Cuprum (Cu), and 0.002% of Nickel (Ni).

A method for preparing the low-alloyed Mg alloy with high ductility and high damping capacities at room temperature in this example is the same as that of Example 1, except that the addition amount of raw materials is set based on the target composition.

Example 3

A low-alloyed magnesium (Mg) alloy with high ductility and high damping capacities at room temperature is composed of the following elements in percentage by mass: 0.85% of Gadolinium (Gd), 0.53% of Zinc (Zn), 0.56% of Zirconium (Zr), 0.013% of impurity elements, and the balance of Mg, where the impurity elements include 0.002% of Ferrum (Fe), 0.009% of Silicon (Si), 0.002% of Cuprum (Cu), and 0.002% of Nickel (Ni).

A method for preparing the low-alloyed Mg alloy with high ductility and high damping capacities at room temperature in this example is the same as that of Example 1, except that the addition amount of raw materials is set based on the target composition.

Example 4

A low-alloyed Mg alloy with high ductility and high damping capacities at room temperature is composed of the following elements in percentage by mass: 0.7% of Gadolinium (Gd), 0.63% of Zinc (Zn), 0.54% of Zirconium (Zr), 0.02% of impurity elements, and the balance of Mg (Mg), where the impurity elements include 0.003% of Ferrum (Fe), 0.007% of Silicon (Si), 0.004% of Cuprum (Cu), and 0.006% of Nickel (Ni).

A method for preparing the low-alloyed Mg alloy with high ductility and high damping capacities at room temperature in this example is the same as that of Example 1, except that the addition amount of raw materials is set based on the target composition.

Example 5

A low-alloyed magnesium (Mg) alloy with high ductility and high damping capacities at room temperature is composed of the following elements in percentage by mass: 0.51% of Gadolinium (Gd), 0.51% of Zinc (Zn), 0.31% of Zirconium (Zr), 0.021% of impurity elements, and the balance of Mg, where the impurity elements include 0.003% of Ferrum (Fe), 0.012% of Silicon (Si), 0.004% of Cuprum (Cu), and 0.002% of Nickel (Ni).

A method for preparing the low-alloyed Mg alloy with high ductility and high damping capacities at room temperature in this example is the same as that of Example 1, except that the addition amount of raw materials is set based on the target composition.

Comparative Example 1

A magnesium (Mg) alloy is composed of the following elements in percentage by mass: 0.98% of Zinc (Zn), 0.58% of Zirconium (Zr), 0.026% of impurity elements, and the balance of Mg, where the impurity elements include 0.004% of Ferrum (Fe), 0.007% of Silicon (Si), 0.006% of Cuprum (Cu), and 0.009% of Nickel (Ni).

The addition of the Mg-30% Gd intermediate alloy as the raw material in Example 1 is omitted and the materials are added according to the target composition, while remaining technical features and a method for preparing the low-alloyed Mg alloy with high ductility and high damping capacities at room temperature are the same as those in Example 1.

Comparative Example 2

A magnesium (Mg) alloy is composed of the following elements in percentage by mass: 0.81% of Gadolinium (Gd), 0.83% of Zinc (Zn), 0.42% of Zirconium (Zr), 0.013% of impurity elements, and the balance of Mg, where the impurity elements include 0.001% of Ferrum (Fe), 0.003% of Silicon (Si), 0.003% of Cuprum (Cu), and 0.006% of Nickel (Ni).

A method for preparing the low-alloyed Mg alloy with high ductility and high damping capacities at room temperature in this example is the same as that of Example 1, except that the addition amount of raw materials is set based on the target composition.

Comparative Example 3

A magnesium (Mg) alloy is composed of the following elements in percentage by mass: 1.46% of Gadolinium (Gd), 0.48% of Zinc (Zn), 0.38% of Zirconium (Zr), 0.014% of impurity elements, and the balance of Mg, where the impurity elements include 0.002% of Ferrum (Fe), 0.007% of Silicon (Si), 0.003% of Cuprum (Cu), and 0.002% of Nickel (Ni).

A method for preparing the low-alloyed Mg alloy with high ductility and high damping capacities at room temperature in this example is the same as that of Example 1, except that the addition amount of raw materials is set based on the target composition.

Testing of Mechanical Properties and Damping Properties

Under room temperature conditions, an Instron 3369 mechanical testing system was used to test the ultimate tensile strength, tensile yield strength and elongation of each of the samples in Examples 1-5 and Comparative Examples 1-3. The test basis is Metallic materials-Tensile testing-Part 1: Method of testing at room temperature (GB/T228.1-2010, China). A DMA Q800 dynamic mechanical analyzer and a single cantilever mode were used to test the damping properties of the samples in Examples 1-5 and Comparative Examples 1-3. The test method is similar to the forced vibration torsion pendulum method described in GB/T13665-2007 of China. That is, the measurement were performed in the form of a forced resonance with a single cantilever beam. The measured damping value is represented by the loss tangent tan φ (φ is the loss angle of strain-stress lag) at a strain of $10^{-3}$ or the reciprocal $Q^{-1}$ of the quality factor. The calculation method of the tan φ is shown in the formula (1).

$$\tan\varphi = E''/E' \quad (1)$$

where E" and E' denote the loss modulus and storage modulus, respectively.

When tan φ<0.1, two damping characterization methods can be approximately converted equivalently, that is, $Q^{-1}$=tan φ. Damping test conditions are as follows: constant temperature T=35° C., frequency f=1 Hz, and strain $\varepsilon=10^{-3}$. The above test results are shown in Table 1.

TABLE 1

Test results of the mechanical properties and damping capacities at room temperature of the samples in Examples 1-5 and Comparative Examples 1-3

| Case | Mg alloy composition (percentage by mass/%) | Mechanical properties at room temperature: Ultimate tensile strength/MPa | Tensile yield strength/MPa | Elongation 1% | Damping capacities at room temperature Q-1 ($\varepsilon = 10^{-3}$) |
|---|---|---|---|---|---|
| Example 1 | Mg-1.49Gd-0.89Zn-0.31Zr | 256 | 211 | 31.7 | 0.02 |
| Example 2 | Mg-1.35Gd-0.53Zn-0.56Zr | 240 | 187 | 33.9 | 0.022 |
| Example 3 | Mg-0.85Gd-0.53Zn-0.56Zr | 231 | 162 | 35.4 | 0.026 |
| Example 4 | Mg-0.7Gd-0.63Zn-0.54Zr | 224 | 136 | 36.6 | 0.031 |
| Example 5 | Mg-0.51Gd-0.51Zn-0.59Zr | 215 | 128 | 39.3 | 0.035 |
| Comparative Example 1 | Mg-0.98Zn-0.58Zr | 206 | 167 | 21.2 | 0.015 |
| Comparative Example 2 | Mg-0.81Gd-0.83Zn-0.42Zr | 268 | 217 | 20.3 | 0.013 |
| Comparative Example 3 | Mg-1.46Gd-0.48Zn-0.38Zr | 273 | 246 | 29.7 | 0.01 |

The test results in Table 1 show that the low-alloyed Mg alloy with high ductility and high damping capacities at room temperature provided by the present disclosure has a tensile strength of 215-256 MPa, a yield strength of 128-211 MPa, an elongation of 31.7-39.3%, and a room-temperature damping capacity (expressed by the reciprocal $Q^{-1}$ of the quality factor at a strain of $10^{-3}$) of 0.02-0.035.

The microscopic morphology of the sample of Example 2 was observed using a transmission electron microscope (TEM), and the observation results are shown in the FIGURE. It can be seen from the FIGURE that in the TEM morphology of the extruded alloy, there are a large number of dislocations (indicated by arrows) inside the grains, so that the alloy has high ductility and high damping capacities.

In summary, low alloying of Mg with Gd, Zn and Zr elements in the present disclosure is capable of making the Mg alloy have excellent ductility and damping capacities, and higher strength, particularly higher tensile yield strength, so that the application prospects of Mg alloys are broader.

The above examples are merely the preferred embodiments of the present invention. It should be noted that for those of ordinary skill in the art, several improvements and embellishments can be made within the protection range of the disclosure without departing the principle of the present invention.

What is claimed is:

1. A preparation method of a magnesium (Mg) alloy, wherein the Mg alloy consists of the following elements in percentage by mass:

0.6-1.4% of gadolinium (Gd), 0.6-0.8% of zinc (Zn), 035-0.55% of zirconium (Zr), and a balance of Mg, a mass ratio of the Gd to the Zn in the Mg alloy is 1.0≤Gd/Zn≤3.0, and a mass percentage of impurity elements in the Mg alloy is equal to or less than 0.1%; and the preparation method of the Mg alloy comprises the following steps:

(1) sequentially melting, refining, keeping static, and semi-continuous casting alloy raw materials to obtain a Mg alloy ingot, wherein the refining is performed by inflating with argon gas, the semi-continuous casting is performed under a mixed $CO_2$ and $SF_6$ gas atmosphere; and (2) sequentially performing a homogenization annealing and an extrusion of the Mg alloy ingot obtained in the step (1) to obtain the Mg alloy;

wherein a temperature of the keeping static in the step (1) is 720-730° C., and a time of the keeping static is 30-90 min.

2. The preparation method according to claim 1, wherein the impurity elements comprise iron (Fe), silicon (Si), copper (Cu), and nickel (Ni), wherein a mass percentage of the Fe is equal to or less than 0.03%, a mass percentage of the Si is equal to or less than 0.03%, a mass percentage of the Cu is equal to or less than 0.01%, and a mass percentage of the Ni is equal to or less than 0.01%.

3. The preparation method according to claim 1, wherein a temperature of the refining in the step (1) is 720-730° C., and a time of the refining is 5-15 min.

4. The preparation method according to claim 1, wherein a temperature of the semi-continuous casting in the step (1) is 705-715° C., a speed of the semi-continuous casting is 100-300 mm/min, and a circulating water flow rate of the semi-continuous casting is 5-25 $m^3$/h.

5. The preparation method according to claim 1, wherein a holding temperature of the homogenization annealing in the step (2) is 480-530° C., and a holding time of the homogenization annealing is 20-30 h.

6. The preparation method according to claim 1, wherein a temperature of the extrusion in the step (2) is 350-450° C., a ratio of the extrusion is equal to or greater than 20, and a speed of the extrusion is 0.2-10 m/min.

7. The preparation method according to claim 1, wherein the Mg alloy obtained in the step (2) has an ultimate tensile strength of 215-256 MPa, a tensile yield strength of 128-211 MPa, an elongation of 31.7-39.3% at room temperature, and a damping capacity ($Q^{-1}$) of 0.02-0.035, wherein the damping capacity is expressed by the reciprocal $Q^{-1}$ of the quality factor at a strain of $10^{-3}$.

* * * * *